US008800289B2

(12) United States Patent
Johnson et al.

(10) Patent No.: US 8,800,289 B2
(45) Date of Patent: Aug. 12, 2014

(54) APPARATUS AND METHOD FOR MIXING FUEL IN A GAS TURBINE NOZZLE

(75) Inventors: Thomas Edward Johnson, Greer, SC (US); Willy Steve Ziminsky, Greenville, SC (US); Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 994 days.

(21) Appl. No.: 12/877,385

(22) Filed: Sep. 8, 2010

(65) Prior Publication Data

US 2012/0055167 A1 Mar. 8, 2012

(51) Int. Cl.

| | |
|---|---|
| ***F02C 7/22*** | (2006.01) |
| ***F02G 1/05*** | (2006.01) |
| ***F02C 7/224*** | (2006.01) |
| ***F02C 7/228*** | (2006.01) |
| ***F23R 3/28*** | (2006.01) |
| ***F23R 3/54*** | (2006.01) |
| ***F01D 9/02*** | (2006.01) |
| ***F23R 3/00*** | (2006.01) |

(52) U.S. Cl.

CPC . *F23R 3/286* (2013.01); *F23R 3/54* (2013.01); *F23R 2900/00002* (2013.01); *F01D 9/023* (2013.01); *F23R 3/005* (2013.01)

USPC ..... 60/742; 60/740; 60/737; 60/746

(58) Field of Classification Search

USPC ..... 60/737, 740, 742, 746–747, 760, 756

See application file for complete search history.

(56) References Cited

U.S. PATENT DOCUMENTS

| | | | | | |
|---|---|---|---|---|---|
| 3,397,962 | A | * | 8/1968 | Squires | 423/656 |
| 3,768,817 | A | * | 10/1973 | Daniels | 277/632 |
| 3,771,500 | A | | 11/1973 | Shakiba | |
| 4,104,873 | A | | 8/1978 | Coffinberry | |
| 4,412,414 | A | * | 11/1983 | Novick et al. | 60/39.23 |
| 5,104,310 | A | | 4/1992 | Saltin | |
| 5,205,120 | A | | 4/1993 | Obländer et al. | |
| 5,213,494 | A | | 5/1993 | Jeppesen | |
| 5,341,645 | A | | 8/1994 | Ansart et al. | |
| 5,439,532 | A | | 8/1995 | Fraas | |
| 5,592,819 | A | | 1/1997 | Ansart et al. | |
| 5,707,591 | A | | 1/1998 | Semedard et al. | |

(Continued)

OTHER PUBLICATIONS

Co-pending U.S. Appl. No. 12/499,777, filed Jul. 8, 2009.

(Continued)

*Primary Examiner* — Ehud Gartenberg
*Assistant Examiner* — Karthik Subramanian
(74) *Attorney, Agent, or Firm* — Dority & Manning, PA

(57) ABSTRACT

A nozzle includes a fuel plenum and an air plenum downstream of the fuel plenum. A primary fuel channel includes an inlet in fluid communication with the fuel plenum and a primary air port in fluid communication with the air plenum. Secondary fuel channels radially outward of the primary fuel channel include a secondary fuel port in fluid communication with the fuel plenum. A shroud circumferentially surrounds the secondary fuel channels. A method for mixing fuel and air in a nozzle prior to combustion includes flowing fuel to a fuel plenum and flowing air to an air plenum downstream of the fuel plenum. The method further includes injecting fuel from the fuel plenum through a primary fuel passage, injecting fuel from the fuel plenum through secondary fuel passages, and injecting air from the air plenum through the primary fuel passage.

9 Claims, 6 Drawing Sheets

(56) References Cited

U.S. PATENT DOCUMENTS

| | | | | |
|---|---|---|---|---|
| 6,098,407 | A | 8/2000 | Korzendorfer et al. | |
| 6,123,542 | A | 9/2000 | Joshi et al. | |
| 6,394,791 | B2 | 5/2002 | Smith et al. | |
| 6,438,961 | B2 | 8/2002 | Tuthill et al. | |
| 6,796,790 | B2 | 9/2004 | Venizelos et al. | |
| 6,968,693 | B2 * | 11/2005 | Colibaba-Evulet et al. | 60/748 |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,260,935 | B2 * | 8/2007 | Colibaba-Evulet et al. | 60/748 |
| 7,631,499 | B2 | 12/2009 | Bland | |
| 7,752,850 | B2 | 7/2010 | Laster et al. | |
| 2004/0216463 | A1 | 11/2004 | Harris | |
| 2008/0016876 | A1 * | 1/2008 | Colibaba-Evulet et al. | 60/776 |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0086439 | A1 | 4/2011 | Choi | |
| 2011/0089266 | A1 | 4/2011 | Stoia et al. | |

OTHER PUBLICATIONS

Co-pending U.S. Appl. No. 12/877,399, filed Sep. 8, 2010.
Co-pending U.S. Appl. No. 13/020,156, filed Feb. 3, 2011.
Co-pending U.S. Appl. No. 13/213,460, filed Aug. 19, 2011.

* cited by examiner

APPARATUS AND METHOD FOR MIXING FUEL IN A GAS TURBINE NOZZLE

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves an apparatus and method for supplying fuel to a gas turbine. Specifically, the present invention describes a nozzle that may be used to supply fuel to a combustor in a gas turbine.

BACKGROUND OF THE INVENTION

Gas turbines are widely used in industrial and power generation operations. A typical gas turbine includes an axial compressor at the front, one or more combustors around the middle, and a turbine at the rear. Ambient air enters the compressor, and rotating blades and stationary vanes in the compressor progressively impart kinetic energy to the working fluid (air) to produce a compressed working fluid at a highly energized state. The compressed working fluid exits the compressor and flows through nozzles in the combustors where it mixes with fuel and ignites to generate combustion gases having a high temperature, pressure, and velocity. The combustion gases expand in the turbine to produce work. For example, expansion of the combustion gases in the turbine may rotate a shaft connected to a generator to produce electricity.

It is widely known that the thermodynamic efficiency of a gas turbine increases as the operating temperature, namely the combustion gas temperature, increases. However, if the fuel and air are not evenly mixed prior to combustion, localized hot spots may exist in the combustor near the nozzle exits. The localized hot spots increase the chance for flame flash back and flame holding to occur which may damage the nozzles. Although flame flash back and flame holding may occur with any fuel, they occur more readily with high reactive fuels, such as hydrogen, that have a higher reactivity and wider flammability range. The localized hot spots may also increase the generation of oxides of nitrogen, carbon monoxide, and unburned hydrocarbons, all of which are undesirable exhaust emissions.

A variety of techniques exist to allow higher operating temperatures while minimizing localized hot spots and undesirable emissions. For example, various nozzles have been developed to more uniformly mix higher reactivity fuel with the working fluid prior to combustion. Oftentimes, however, the higher reactivity fuel nozzles include multiple mixing tubes that result in a larger differential pressure across the nozzles. In addition, the higher reactivity fuel nozzles often do not include mixing tubes in the center portion of the nozzles. The absence of tubes from the center portion increase the need for higher differential pressure to meet the required mass flow rate. As a result, continued improvements in nozzle designs that can support increasingly higher combustion temperatures and higher reactive fuels would be useful.

BRIEF DESCRIPTION OF THE INVENTION

Aspects and advantages of the invention are set forth below in the following description, or may be obvious from the description, or may be learned through practice of the invention.

One embodiment of the present invention is a nozzle that includes a fuel plenum and an air plenum downstream of the fuel plenum. At least one primary fuel channel includes an inlet in fluid communication with the fuel plenum and a primary air port in fluid communication with the air plenum. A plurality of secondary fuel channels radially outward of the at least one primary fuel channel includes a secondary fuel port in fluid communication with the fuel plenum. A shroud circumferentially surrounds the plurality of secondary fuel channels.

Another embodiment is a nozzle that includes a shroud circumferentially surrounding the nozzle and a plurality of barriers inside the shroud that extend radially across the nozzle and define a fuel plenum and an air plenum. The air plenum is downstream of the fuel plenum. At least one primary fuel channel includes an inlet in fluid communication with the fuel plenum and a primary air port in fluid communication with the air plenum. A plurality of secondary fuel channels radially outward of the at least one primary fuel channel include a secondary fuel port in fluid communication with the fuel plenum.

The present invention also includes a method for mixing fuel and air in a nozzle prior to combustion. The method includes flowing fuel to a fuel plenum and flowing air to an air plenum downstream of the fuel plenum. The method further includes injecting fuel from the fuel plenum through at least one primary fuel passage, wherein the at least one primary fuel passage is aligned with an axial centerline of the nozzle. The method also includes injecting fuel from the fuel plenum through secondary fuel passages, wherein the secondary fuel passages are aligned radially outward of the primary fuel passages and injecting air from the air plenum through the at least one primary fuel passage.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
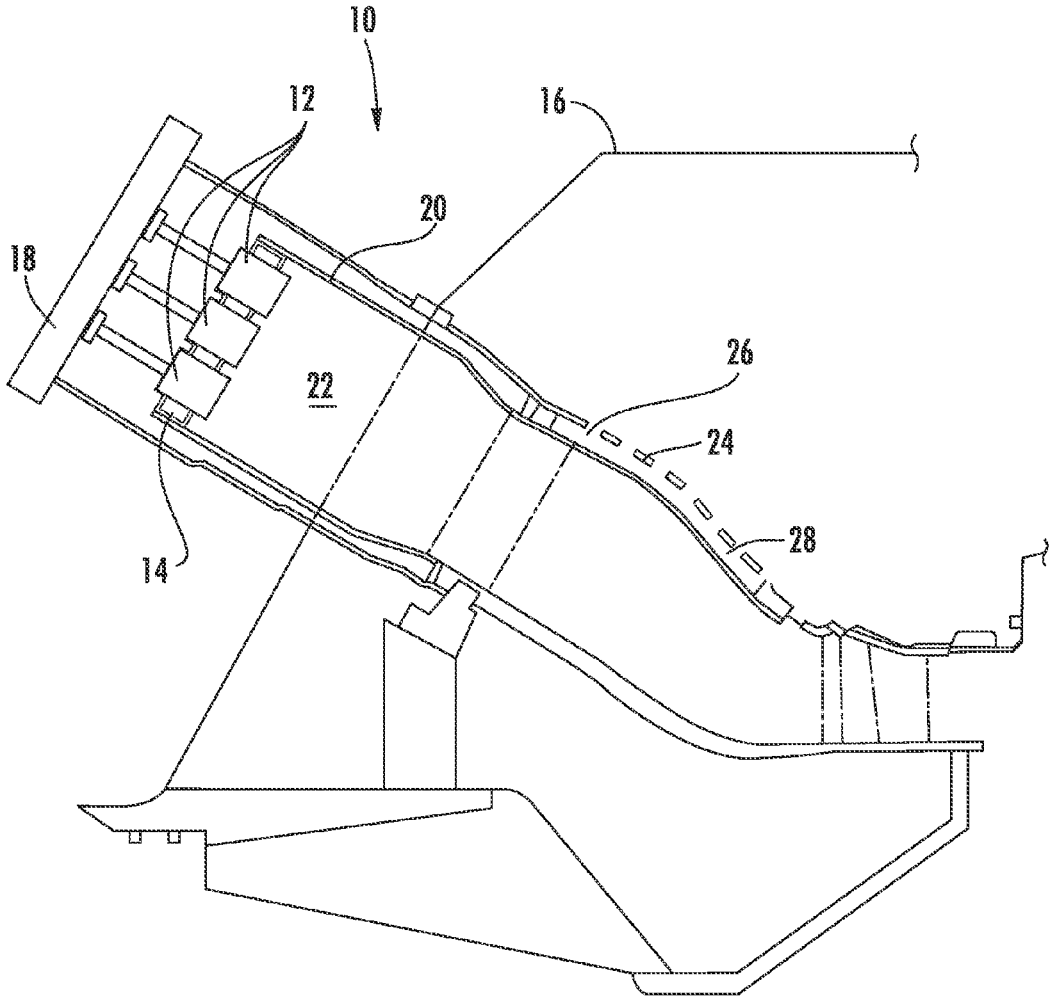
FIG. 1 is a simplified cross-section of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a nozzle having multiple fuel channels that mix fuel and air prior to combustion. In general, the fuel flows into a fuel plenum in the nozzle. The air, generally comprising a compressed working fluid from a compressor, flows into a separate air plenum downstream of the fuel plenum. Fuel from the fuel plenum then flows or is injected into one or more primary fuel channels aligned with an axial centerline of the nozzle and a plurality of secondary fuel channels arranged radially outward of the primary fuel channels. Air from the air plenum flows or is injected into the primary fuel channels to mix with the fuel therein before exiting the nozzle. Air flowing outside of the nozzle and outside of the air plenum flows into the secondary fuel channels to mix with the fuel therein before exiting the nozzle. In this manner, the primary and secondary fuel channels provide more evenly mixed fuel and air radially across the entire downstream face of the nozzle.

FIG. 1 shows a simplified cross-section of a combustor 10 according to one embodiment of the present invention. As shown, the combustor 10 generally includes one or more nozzles 12 radially arranged in a top cap 14. A casing 16 may surround the combustor 10 to contain the air or compressed working fluid exiting the compressor (not shown). An end cap 18 and a liner 20 may define a combustion chamber 22 downstream of the nozzles 12. A flow sleeve 24 with flow holes 26 may surround the liner 20 to define an annular passage 28 between the flow sleeve 24 and the liner 20.

Figure 2:
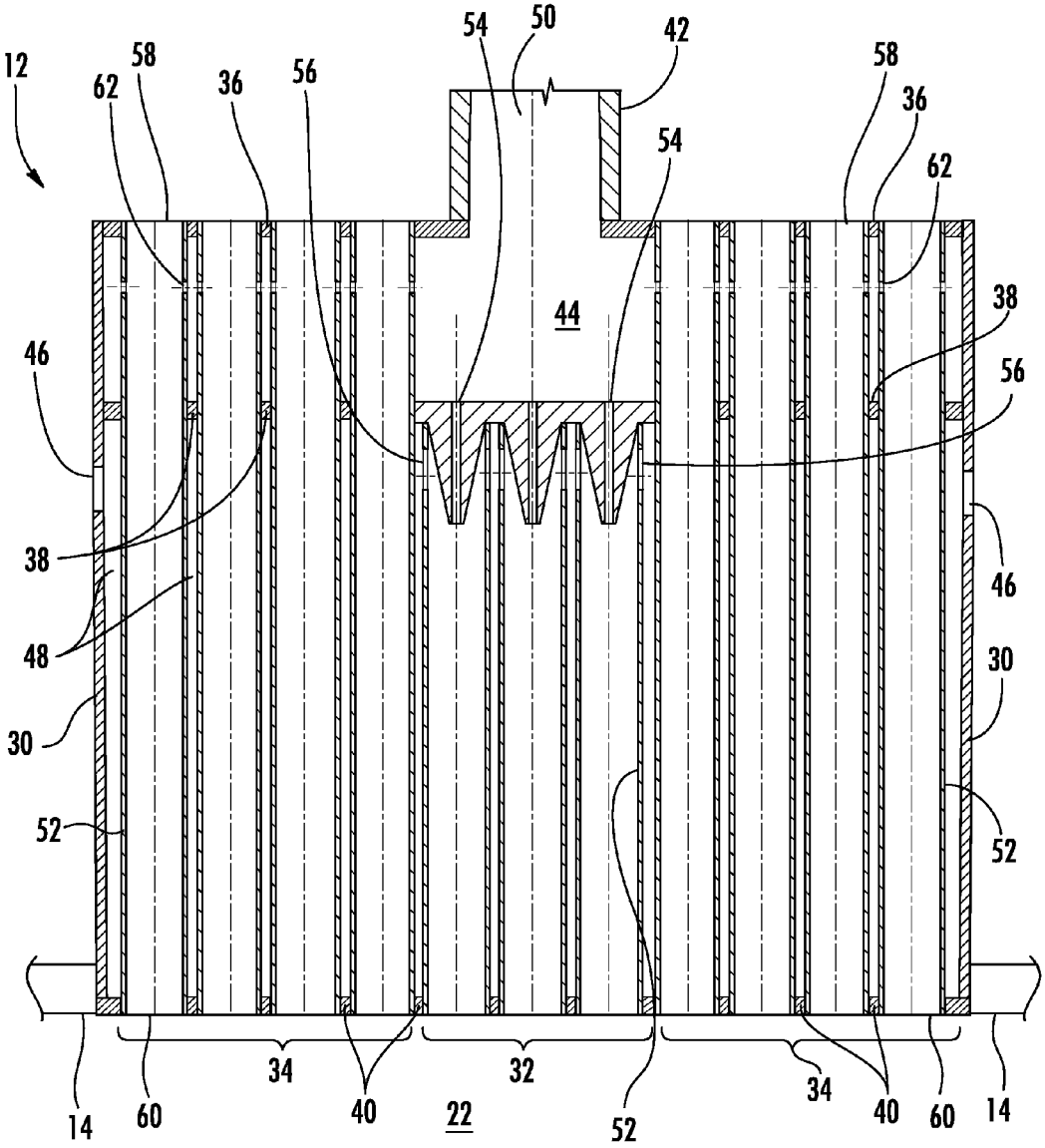
FIG. 2 is an enlarged cross-section of a nozzle according to one embodiment of the present invention.

As shown in FIG. 2, the nozzle 12 generally includes a shroud 30, primary or inner fuel channels 32, and secondary or outer fuel channels 34. The shroud 30 circumferentially surrounds the primary and secondary fuel channels 32, 34 and may include one or more divider plates or barriers that define discrete chambers or sections inside the nozzle 12. For example, as shown in FIG. 2, top, middle, and bottom barriers 36, 38, 40 inside the shroud 30 may extend radially across the width or diameter of the nozzle 12. In this manner, fuel may enter the nozzle 12, for example through a fuel conduit 42, and flow into a fuel plenum 44 defined by the top and middle barriers 36, 38. Similarly, air or compressed working fluid from the compressor may flow through one or more air ports 46 in the shroud 30 into an air plenum 48 defined by the middle and bottom barriers 38, 40.

Figure 3:
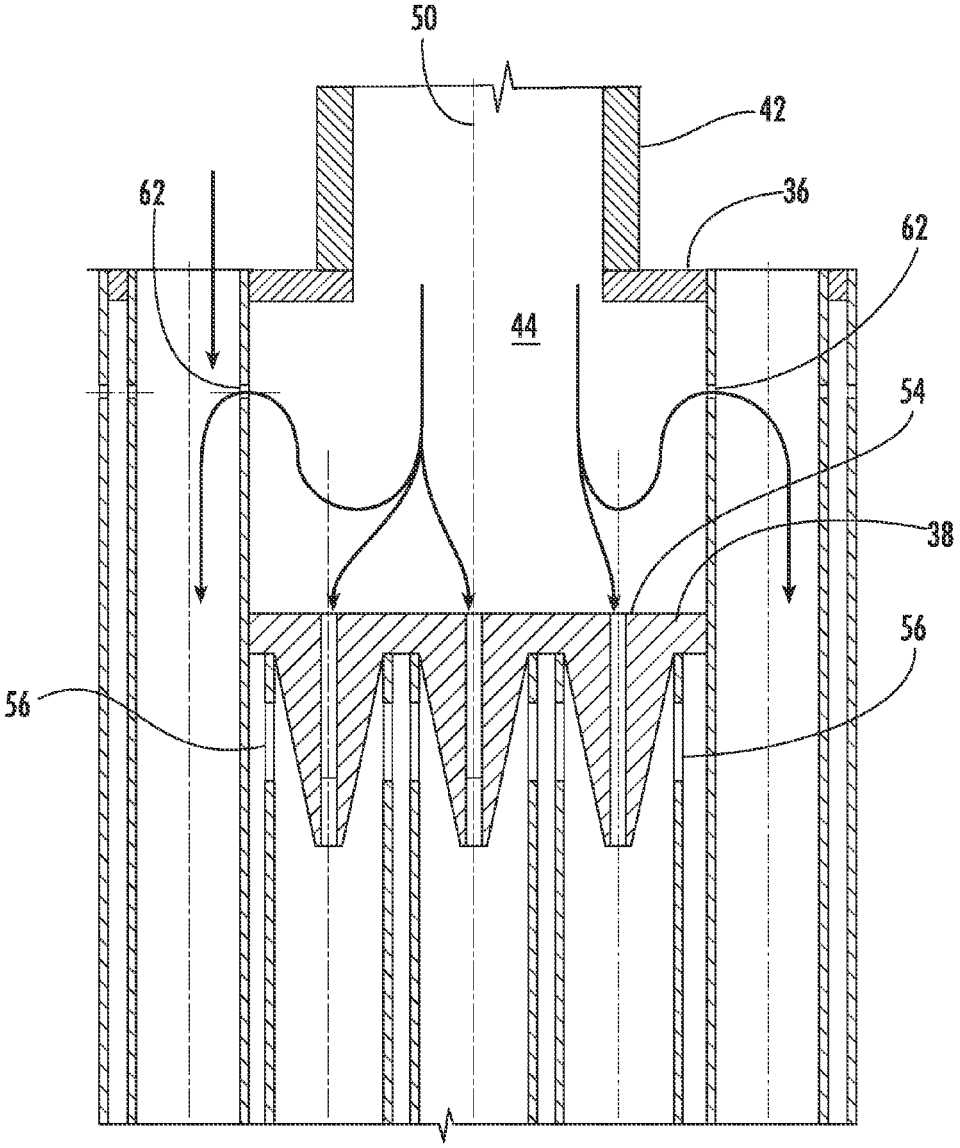
FIG. 3 is an enlarged cross-section of a portion of the nozzle shown in FIG. 2 according to one embodiment of the present invention.
Figure 4:
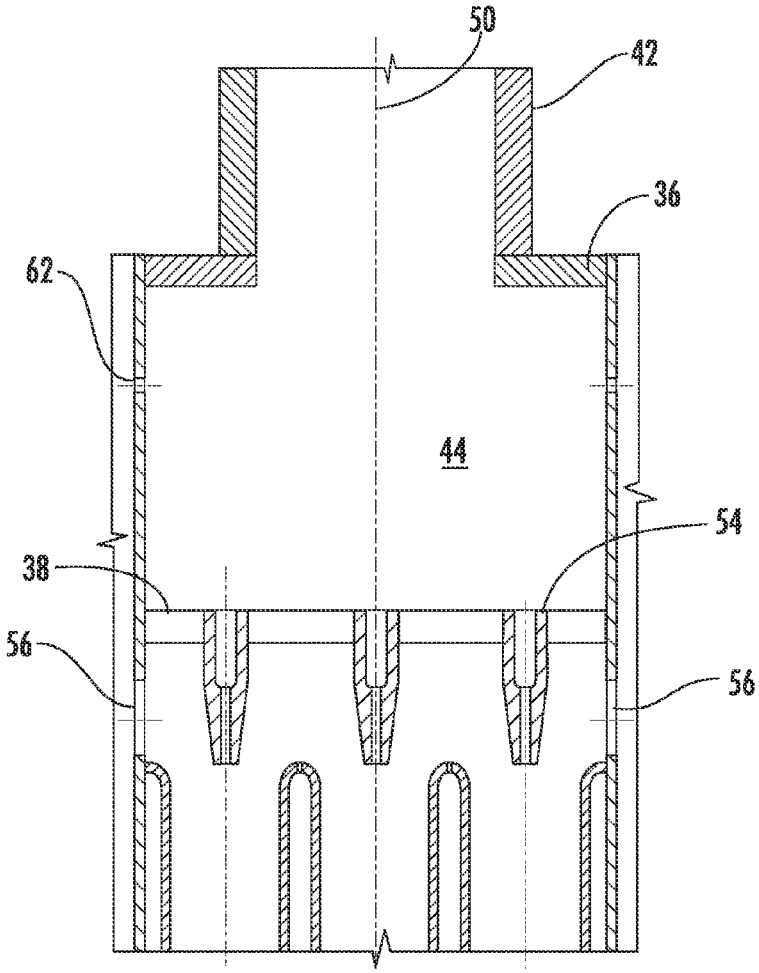
FIG. 4 is an enlarged cross-section of a portion of the nozzle shown in FIG. 2 according to an alternate embodiment of the present invention.

The primary fuel channels 32 generally comprise a tube or passage 52, an inlet 54, and a primary air port 56. The tube or passage 52 may be round, oval, square, triangular, or any known geometric shape. The inlet 54 is in fluid communication with the fuel plenum 44 and may simply comprise an opening in the upstream end of the tube or passage 52. Alternately, the inlet 54 may comprise an aperture through the middle barrier 38. For example, as shown in FIGS. 2 and 3, the middle barrier 38 may be generally coincident with the top of the primary fuel passages 32 so that the aperture through the middle barrier 38 functions as the inlet 54 to the primary fuel channels 32. Alternately, as shown in FIG. 4, the middle barrier 38 may be higher than the top of the primary fuel passages 32. In either event, the inlet 54 may have a varying diameter, thus creating a venturi effect to accelerate the fuel flow through the primary fuel channels 32. The primary air port 56 is similarly in fluid communication with the air plenum 48. Air or compressed working fluid from the compressor may thus flow into the air plenum 48 through the air ports 46 in the shroud 30. The air may then flow or be injected from the air plenum 48 through the primary air port 56 into the primary fuel channels 32.

The primary or inner fuel channels 32 are generally axially aligned or coincident with a centerline 50 of the nozzle 12 and may comprise a single fuel channel or multiple fuel channels, as shown in FIG. 2. As shown in FIGS. 2, 3, and 4, each primary fuel channel generally extends parallel to one another from the fuel plenum 44 through the air plenum 48 to the downstream exit of the nozzle 12. As a result, each primary fuel channel 32 may pass through one or more of the middle or bottom barriers 38, 40, depending on the length of the primary fuel channel 32. For example, as shown in FIG. 2, the primary fuel channels 32 may pass through the middle and bottom barriers 38, 40. In this manner, the primary fuel channels 32 are able to provide a mixture of fuel and air to the combustion chamber 22 through the center-most portion of the nozzle 12.

The secondary fuel channels 34 are generally radially outward of the primary fuel channels 32 and surround the primary fuel channels 32. The secondary fuel channels comprise tubes or passages 52, as previously described, that may extend parallel to one another through one or more barriers 36, 38, 40 along the axial length of the nozzle 12. In addition, the secondary fuel channels 34 generally include an inlet 58, an outlet 60, and a secondary fuel port 62. The inlet 58 and outlet 60 may simply comprise openings at the upstream and downstream ends of the secondary fuel channels 34 that permit the free flow of air through the secondary fuel channels 34. The secondary fuel port 62 is in fluid communication with the fuel plenum 44 so that fuel may flow or be injected from the fuel plenum 44 into the secondary fuel channels 34. Depending on the design needs, some or all of the secondary fuel channels 34 may include one or more secondary fuel ports 62. The secondary fuel port 62 may be angled with respect to the axial centerline 50 of the nozzle 12 to vary the angle at which the fuel enters the secondary fuel channels 34, thus varying the distance that the fuel penetrates into the secondary fuel channels 34 before mixing with the air. The fuel and air thus mix in the secondary fuel channels 34 before exiting the nozzle 12 into the combustion chamber 22.

Figure 5:
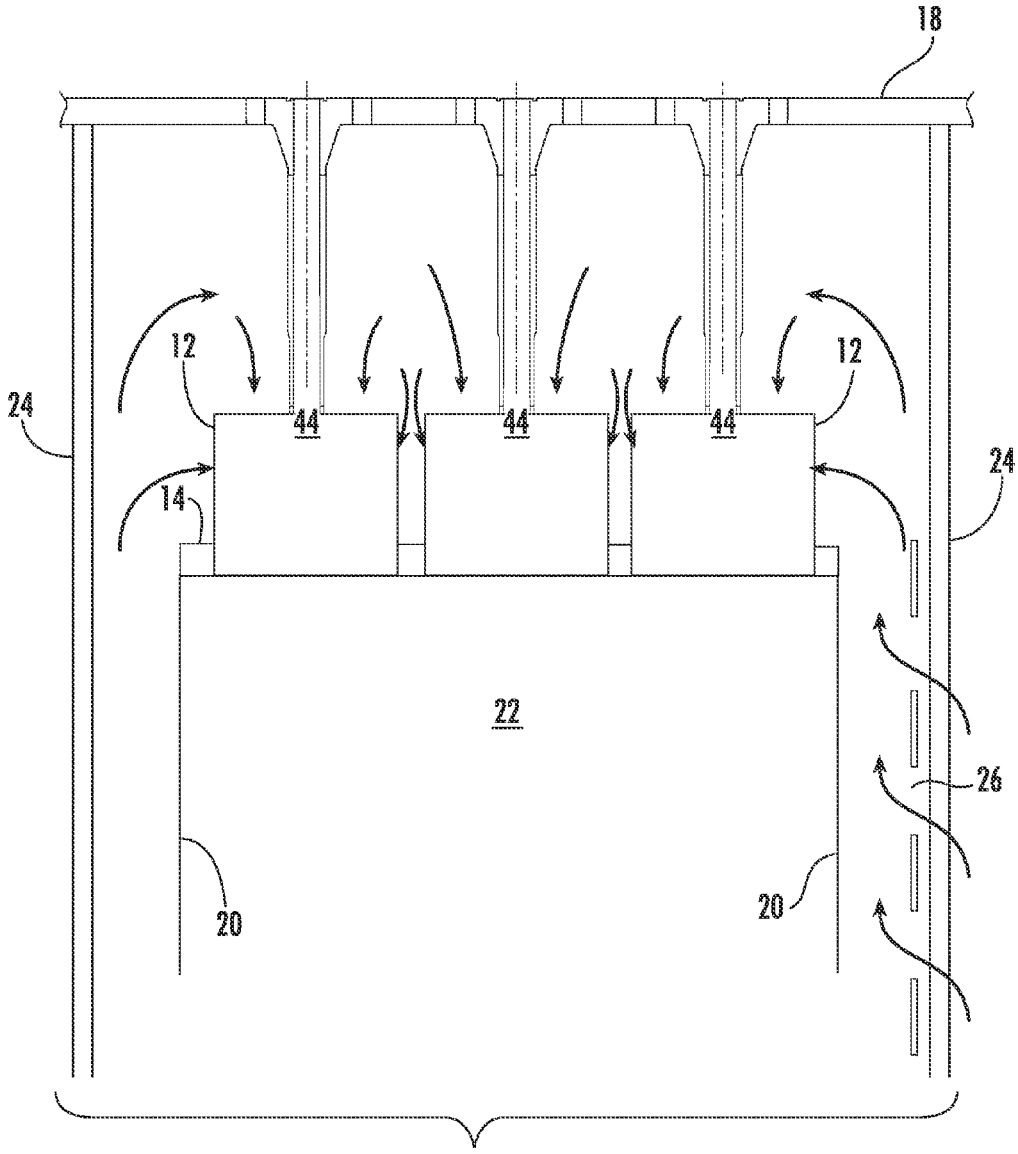
FIG. 5 is an enlarged cross-section of a portion of the combustor shown in FIG. 1.

FIG. 5 provides an enlarged cross-section view of a portion of the combustor 10 shown in FIG. 1 with arrows to illustrate the various flow paths of the air or compressed working fluid from the compressor. As shown, the air may enter the annular passage 28 through the flow holes 26 in the flow sleeve 24. The air may then flow through the annular passage 28 toward the nozzles 12. As the air reaches the nozzles 12 and passes along the outside of the shroud 30, some of the air may flow through the air ports 46 into the air plenum 48. Once in the air plenum 48, the air may flow or be injected through the primary air ports 56 into the primary fuel channels 32 where it mixes with the fuel before exiting the nozzle 12 into the combustion chamber 22. The remainder of the air passing along the outside of the shroud 30 reaches the end cap 18 where it reverses direction and flows into the inlet 58 of the secondary fuel channels 34. Once in the secondary fuel channels 34, the air mixes with fuel entering through the secondary fuel ports 62 before exiting the nozzle 12 into the combustion chamber 22.

Figure 6:
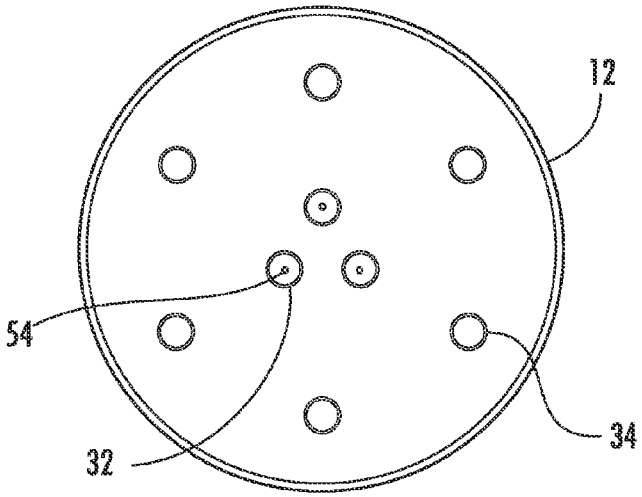
FIG. 6 is a plan view of a nozzle according to one embodiment of the present invention.
Figure 7:
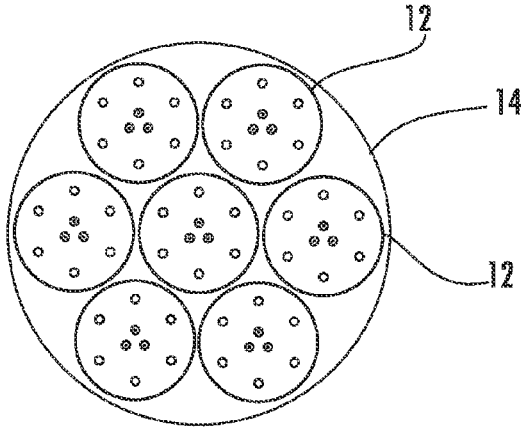
FIG. 7 is a plan view of a combustor top cap according to one embodiment of the present invention.
Figure 8:
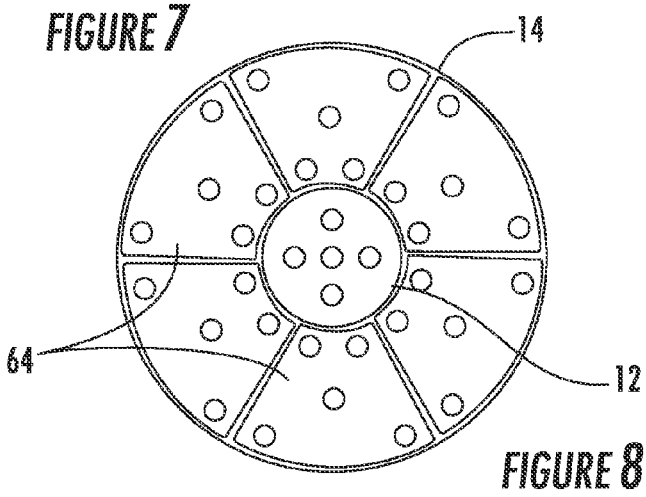
FIG. 8 is a plan view of a combustor top cap according to an alternate embodiment of the present invention.

FIGS. 6, 7, and 8 provide various plan views of the top cap 14 looking upstream from the combustion chamber 22. For example, FIG. 6 provides a plan view of the nozzle 12 previously described and illustrated. As shown in FIG. 6, the primary and secondary fuel channels 32, 34 appear as circles. The inlet 54 is visible in the primary fuel channels 32, and the secondary fuel channels 34 are radially outward of and surround the primary fuel channels 32. As shown in FIGS. 7 and 8, the nozzles 12 may be circular, triangular, square, oval, or virtually any shape and may be arranged in various geometries in the top cap 14. For example, the nozzles 12 may be arranged as six nozzles surrounding a single nozzle, as shown in FIG. 7. Alternately, a series of pie shaped nozzles 64 may surround a circular nozzle 12, as shown in FIG. 8. One of ordinary skill in the art should understand that the present invention is not limited to any particular geometry of individual nozzles or nozzle arrangements, unless specifically recited in the claims.

The various embodiments of the present invention may provide several advantages over existing nozzles. For example, the use of primary and secondary fuel channels 32, 34 allows for more flow of fuel and air through the nozzle 12, thus reducing the pressure drop it takes for the air to flow through the nozzle 12. In addition, the primary and secondary fuel channels 32, 34 provide mixed fuel and air across the entire downstream surface of the nozzle 12 to the combustion chamber 22. This provides a more uniform flow of fuel and air into the combustion chamber 22, thereby reducing any recirculation zones at the exit of the nozzle 12. Furthermore, the flow of fuel and air over a greater portion of the nozzle 12 provides additional cooling to the downstream face of the nozzle 12, thereby reducing the need for parasitic cooling flow to the face of the nozzle 12. Lastly, the nozzles 12 within the scope of the present invention may be installed in existing combustors, allowing for less expensive modifications of existing nozzles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A fuel nozzle, comprising:

a top divider plate extending radially across a diameter of an annular shroud;

a middle divider plate axially spaced from the top divider plate and circumscribed within the shroud, wherein the top divider plate, the middle divider plate and the outer shroud at least partially define a fuel plenum;

a bottom divider plate axially spaced from the middle divider plate, wherein the bottom divider plate, the middle divider plate and the shroud at least partially define an air plenum;

a plurality of primary fuel channels which extend axially through the air plenum from the middle divider plate at least partially through the bottom divider plate, each primary fuel channel having an inlet in fluid communication with the fuel plenum; and a plurality of secondary fuel channels arranged in an annular array around the plurality of primary fuel channels, wherein the secondary fuel channels comprises a plurality of tubes which extend through the top divider plate, the fuel plenum and the bottom divider plate.

2. The fuel nozzle as in claim 1, wherein the inlet of each primary fuel passage is axially spaced from the top divider plate.

3. The fuel nozzle as in claim 1, wherein the primary fuel passages comprise a plurality of parallel tubes in fluid communication with the inlets, wherein each tube defines a passage through the air plenum and out of an exit of the fuel nozzle.

4. The fuel nozzle as in claim 1, wherein each primary fuel channel includes a primary air port, the primary air port being in fluid communication with the air plenum.

5. The fuel nozzle as in claim 1, wherein the at least one primary fuel channel is axially aligned with a centerline of the fuel nozzle.

6. The fuel nozzle as in claim 1, wherein each of the plurality of secondary fuel channels includes a secondary fuel port in fluid communication with the fuel plenum.

7. The fuel nozzle as in claim 1, wherein the shroud defines an air port in fluid communication with the air plenum.

8. The fuel nozzle as in claim 1, wherein the top divider plate extends radially and circumferentially across a diameter of the shroud, the middle divider plate extends radially and circumferentially across the diameter of the shroud and the bottom divider plate extends radially and circumferentially across the diameter of the shroud downstream from the middle divider plate.

9. The fuel nozzle as in claim 1, further comprising a fluid conduit coaxially aligned with an opening defined by the top divider plate, wherein the fluid conduit is in fluid. communication with the fuel plenum.

* * * * *

UNITED STATES PATENT AND TRADEMARK OFFICE

CERTIFICATE OF CORRECTION

PATENT NO. : 8,800,289 B2
APPLICATION NO. : 12/877385
DATED : August 12, 2014
INVENTOR(S) : Johnson et al.

It is certified that error appears in the above-identified patent and that said Letters Patent is hereby corrected as shown below:

In the Claims

In Column 6, Line 50, in Claim 9, delete "fluid." and insert -- fluid --, therefor.

Signed and Sealed this
Twenty-sixth Day of May, 2015

Michelle K. Lee

Michelle K. Lee
*Director of the United States Patent and Trademark Office*